US007195424B2

(12) United States Patent
Lindley

(10) Patent No.: US 7,195,424 B2
(45) Date of Patent: Mar. 27, 2007

(54) ROLLER SCREED

(76) Inventor: Joseph W. Lindley, 201 Matthew Dr., Paducah, KY (US) 42001

( * ) Notice: Subject to any disclaimer, the term of this patent is extended or adjusted under 35 U.S.C. 154(b) by 0 days.

(21) Appl. No.: 11/381,335

(22) Filed: May 2, 2006

(65) Prior Publication Data

US 2006/0251475 A1 Nov. 9, 2006

Related U.S. Application Data

(60) Provisional application No. 60/677,445, filed on May 3, 2005.

(51) Int. Cl.
*E01C 9/22* (2006.01)

(52) U.S. Cl. ..... 404/118

(58) Field of Classification Search ..... 404/96, 404/97, 114, 118
See application file for complete search history.

(56) References Cited

U.S. PATENT DOCUMENTS

| | | | | |
|---|---|---|---|---|
| 1,302,275 | A | 4/1919 | Asmore et al. | |
| 1,364,604 | A | 1/1921 | Asmore et al. | |
| 1,736,413 | A | 11/1929 | Litchenberg | |
| 1,760,596 | A | 5/1930 | Heltzel | |
| 2,025,703 | A | 12/1935 | Baily et al. | |
| 2,252,188 | A * | 8/1941 | Krehbiel | 404/95 |
| 2,314,985 | A | 3/1943 | Jackson | |
| 3,052,167 | A | 9/1962 | Beale | |
| 3,605,577 | A * | 9/1971 | Bik | 404/122 |
| 3,605,582 | A | 9/1971 | Kaltenegger | |
| 3,605,852 | A * | 9/1971 | Kaltenegger | 404/117 |
| 3,698,293 | A | 10/1972 | Wagner | |
| 4,142,815 | A * | 3/1979 | Mitchell | 404/103 |
| 4,702,640 | A * | 10/1987 | Allen | 404/75 |
| 4,964,754 | A | 10/1990 | Garner et al. | |
| 5,016,319 | A | 5/1991 | Stigen | |
| 5,062,738 | A | 11/1991 | Owens | |
| 5,348,418 | A | 9/1994 | Campbell | |
| 5,456,549 | A | 10/1995 | Paladeni | |
| 5,562,361 | A | 10/1996 | Allen | |
| 5,664,908 | A | 9/1997 | Paladeni | |
| 5,803,656 | A * | 9/1998 | Turck | 404/103 |
| 6,350,083 | B1 | 2/2002 | Paladeni | |
| 6,402,425 | B1 * | 6/2002 | Paladeni | 404/118 |
| 6,503,558 | B2 * | 1/2003 | Williamson | 427/180 |

* cited by examiner

*Primary Examiner*—Gary S. Hartmann
(74) *Attorney, Agent, or Firm*—Barnes & Thornburg LLP

(57) ABSTRACT

A portable powered roller screed apparatus includes a rotating roller assembly, a first operator roller controller coupled to a first end of the roller assembly, and a second operator roller controller coupled to a second end of the roller assembly. The first operator roller controller includes a rotary driver, a roller mover coupled to the rotary driver, and a speed control coupled to the roller mover, the speed control providing an input to the rotary driver to control the speed of the rotary driver.

15 Claims, 6 Drawing Sheets

ROLLER SCREED

This application claims priority under 35 U.S.C. § 119(e) to U.S. Provisional Application Ser. No. 60/677,445, filed May 3, 2005, which is expressly incorporated by reference herein.

BACKGROUND

The present disclosure relates to a roller screed, and particularly a powered roller screed. More particularly, this disclosure relates to a portable powered roller screed.

SUMMARY

According to the present disclosure, a powered roller screed apparatus is provided for leveling uncured concrete. The roller screed apparatus comprises a roller, a first operator roller controller coupled to the roller at a first end, and a second operator roller controller coupled to the roller at the second end. The roller includes a longitudinal axis and a cylindrical outer surface about the longitudinal axis. The first operator roller includes a rotary driver coupled to the roller and configured to rotate the roller about the longitudinal axis of the roller. The first operator roller controller also includes a roller mover coupled to the rotary driver and a speed control coupled to the rotary mover and configured to provide an input to the rotary driver.

In an illustrative embodiment, the rotary driver comprises a power source configured to provide rotational output and a rotary transmitter coupled to the power source and the roller, the rotary transmitter transferring the rotational output from the power source directly to the roller through a single stage at a ratio of about 1:1.

Illustratively, the power source may comprise an internal combustion engine. In other embodiments, the power source may comprise an electric motor.

In some illustrative embodiments, roller screed apparatus comprises a roller and an operator controller means for smoothing uncured concrete by rotating the roller to move uncured concrete while simultaneously pulling the roller screed apparatus such that the roller levels and smoothes the uncured concrete to a predefined level.

In some embodiments, the means for rotating the roller comprises power source means for providing rotational output and rotational transmitter means for transmitting the rotational output from the power source to the roller to roll the roller about a longitudinal axis of the roller. The rotational output from the power source means may have an axis of rotation that is generally parallel to the longitudinal axis of the roller. The rotational transmitter means may transmit rotational output from the power source to the roller through a single stage at a ratio of about 1:1.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 2:
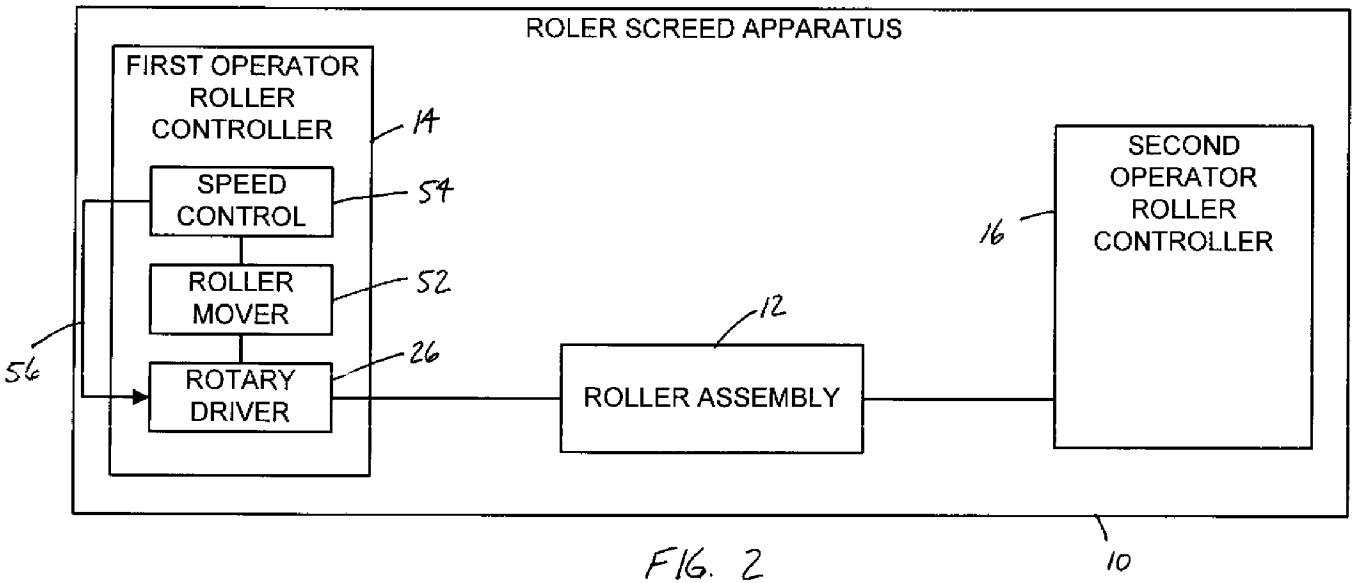
FIG. 2 is a block diagram of the roller screed apparatus of FIG. 1 diagrammatically showing the relationship of the roller, first operator controller, and second roller controller.
Figure 3:
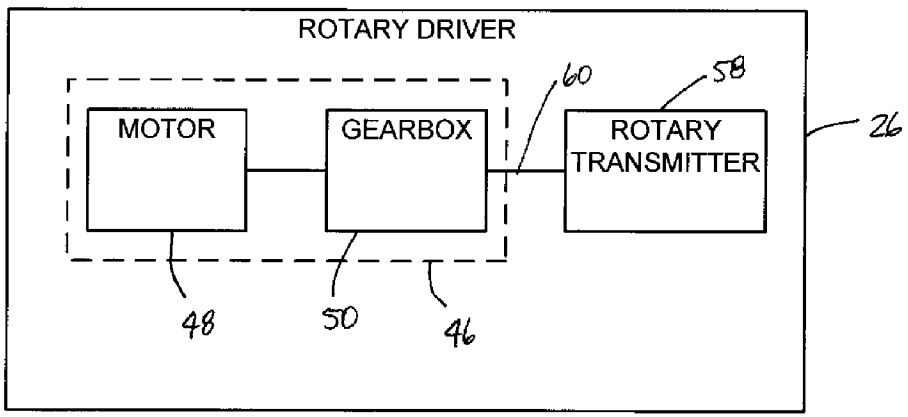
FIG. 3 is a block diagram of the components of the rotary driver of FIG. 2.

Referring to an illustrative diagram of a roller screed apparatus 10 shown in FIG. 2, a roller screed apparatus 10 comprises a first operator roller controller 14 coupled to a roller assembly 12 at one end and second operator roller controller 16 coupled to roller assembly 12 at the opposite end of roller assembly 12. First operator roller controller 14 comprises a rotary driver 26, a roller mover 52 coupled to rotary driver 26, and a speed control 54 coupled to rotary mover 52, speed control 54 providing an input signal 56 to rotary driver 26. As shown illustratively in FIG. 3, rotary driver 26 comprises a power source 46 and a rotary transmitter 58. Power source 46 comprises a motor 48 and a gearbox 50. Motor 48 outputs rotational motion to gearbox 50. Gearbox 50 reduces the speed of rotational motion through an output 60 to rotary transmitter 58.

Figure 1:
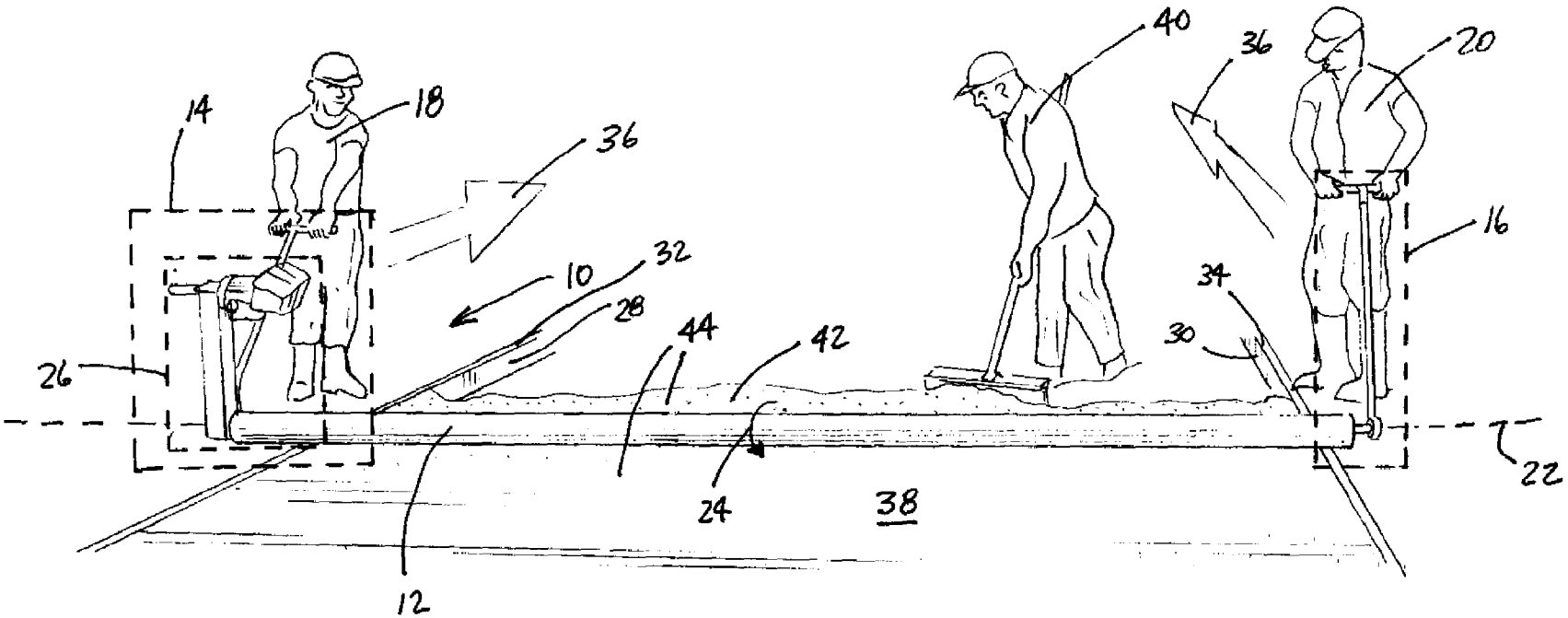
FIG. 1 is a perspective view of a roller screed apparatus which has a powered rotating roller, the roller being moved by a first operator shown at the left end of the figure using a first operator roller controller and a second operator at the right of the figure using a second operator roller controller, the operators pulling the rotating roller over the top surface of forms in a working direction while a third operator feeds uncured concrete to be smoothed.

In one illustrative embodiment of a powered roller screed apparatus 10 shown in FIG. 1, roller assembly 12 rotates in the direction of arrow 24 about a rotational axis 22 which is the longitudinal axis of roller assembly 12. First operator roller controller 14 is positioned on the left side of FIG. 1 and is coupled to roller assembly 12 at a first end. Second operator controller 16 is coupled to roller assembly 12 at a second end and is positioned to the right in FIG. 1.

In use, roller assembly 12 is positioned on a pair of forms 28 (shown at the left side of FIG. 1) and 30 (shown at the right side of FIG. 1) and is moved in a working direction as depicted by two arrows 36, 36 by a first operator 14 and a second operator 20 as roller assembly 12 rotates to level uncured concrete 44. Rotary driver 26 drives roller assembly 12 about axis 22. Roller assembly 12 is supported on top surfaces 32 and 34 of forms 28 and 30 respectively and rotation of roller assembly 12 works the uncured concrete 44 to form a leveled portion 38. A third operator 40 moves unleveled uncured concrete 42 into position such that roller assembly 12 has sufficient concrete 44 across the length of roller assembly 12 to work the concrete 44 down to a level which is generally coplanar with the top surfaces 32 and 34 of forms 28 and 30 respectively. As roller screed apparatus 10 is moved in working direction 36, excess unleveled concrete 42 is moved by the rotation of roller assembly 12 to fill in any low spots in the unleveled concrete 42. Using an appropriate rotational speed and travel speed in working direction 36, first operator 14 and second operator 20 may level and pre-finish sections of concrete 44 faster than the traditional method of hand screeding and hand leveling.

Figure 4:
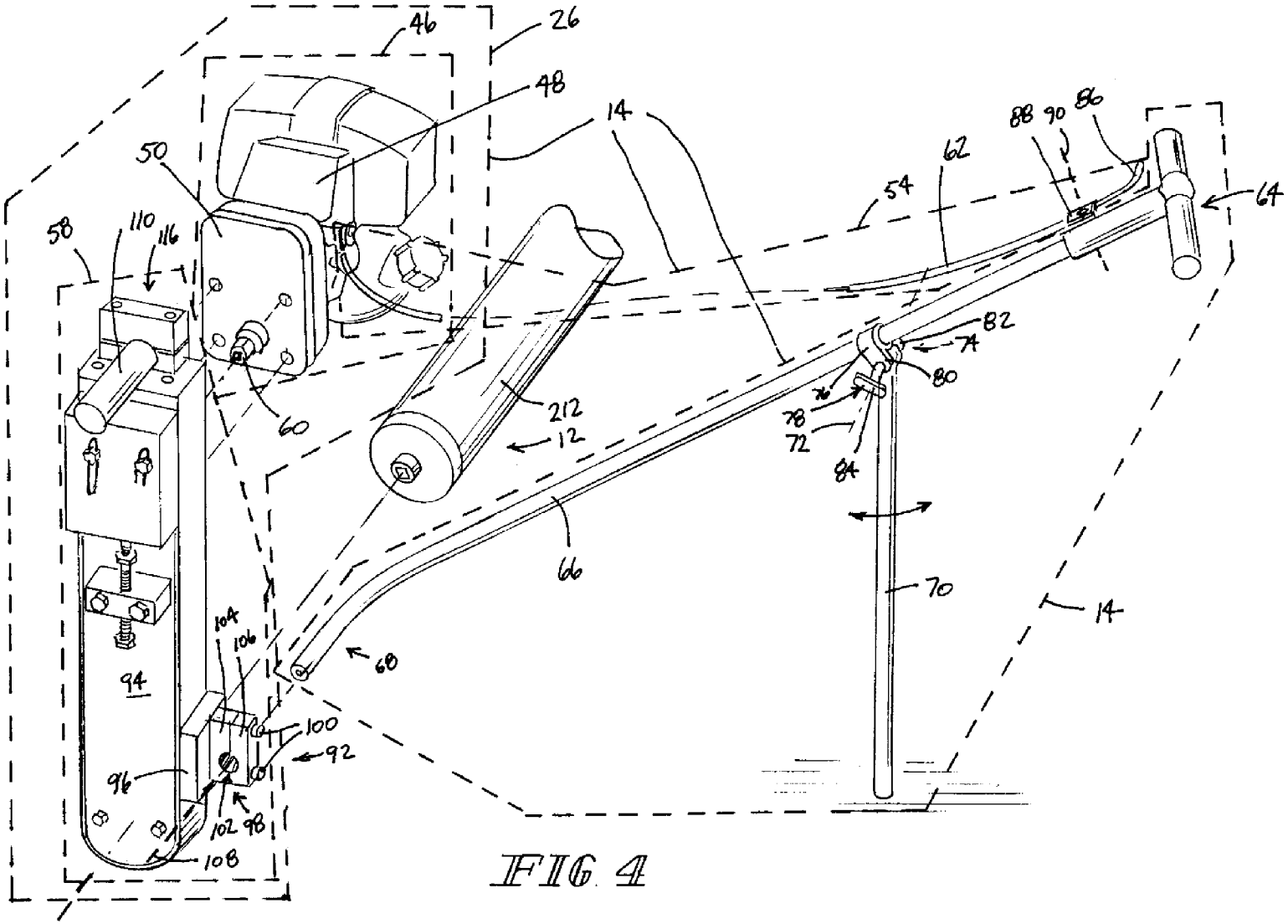
FIG. 4 is an exploded perspective assembly view of a portion of the roller screed apparatus of FIG. 1 showing a portion of the roller including a driven hub having a driver connector at one end, first roller mover including a shaft and a leg, and a rotary driver having a power source with a rotary output and a rotary transmitter transferring motion from the rotary output to the roller.

Referring now to FIG. 4, the illustrative embodiment of first operator roller controller 14 comprises rotary driver 26, roller mover 52 coupled to rotary driver 26, and speed control 54 coupled to roller mover 52 and communicating signal 56 through a throttle cable 62. Rotary driver 26 comprises power source 46 and rotary transmitter 58. In the illustrative embodiment of FIG. 4, power source 46 comprises motor 48 and gearbox 50. Illustratively, motor 48 is an internal combustion engine and gearbox 50 provides a 40:1 gear reduction to transfer the output from motor 48 to roller assembly 12 such that the speed of rotation about axis 22 is acceptable for roller screeding uncured concrete 44. In other embodiments, power source 46 may be a direct drive electric motor. In other embodiments, motor 48 may be an electric motor.

Various gear reduction ratios may be utilized in gearbox 50. For example, in some embodiments motor 48 may be a higher or lower speed internal combustion engine and gearbox 50 may have any of a number of ratios based on the size of motor 48 and the speed of rotational output from motor 48. Roller assembly 12 comprises a roller tube 212 having a diameter of about 4.5 inches. In other embodiments, roller tube 212 may be larger or smaller diameters and the reduction ratio of gearbox 50 may be chosen to control the rotational speed of roller tube 212 about axis 22.

In the illustrative embodiment of FIG. 4, roller mover 52 comprises a t-shaped grip 64 coupled to a shaft 66. Shaft 66 is bent at 90 degrees to form a mount end 68. As will be discussed in more detail below, mount end 68 is received in a controller support assembly 70 to couple shaft 66 to rotary transmitter 58. Roller mover 52 further comprises a leg 70 coupled to shaft 66. Leg 70 pivots about an axis 72 between a use position shown in FIG. 4 and an out-of-the-way position (not shown). In the use position, leg 70 supports roller screed apparatus 10 in an upright position such that rotary driver 26 is maintained in an upright position when roller screed apparatus 10 is not in use.

Leg 70 is coupled to shaft 66 through a coupler 74. Coupler 74 comprises a lock collar 76 received on shaft 66 and a lock 78. Lock 78 comprises a t-shaped handle 84 and a threaded shaft (not shown). Lock collar 76 comprises two flanges 80 and 82. The threaded shaft of lock 78 is received through an aperture (not shown) in flange 80 and through an aperture (not shown) in leg 70. Flange 82 comprises a threaded hole (not shown) configured to receive the threaded shaft. Lock 78 is tightened by rotating handle 84 in a clockwise direction and is released by rotating handle 84 in a counter-clockwise direction. As lock 78 is tightened, flanges 80 and 82 are drawn together against leg 70 such that lock collar 76 is frictionally locked to shaft 66 and leg 70 is limited from rotating about axis 72 due to the clamp pressure between flanges 80 and 82 and leg 70. When lock 78 is released, leg 70 is positionable to any of a number of positions about axis 72. Once a position is selected, lock 78 is tightened to secure leg 70 in place. In this way, leg 70 may be positioned to support roller screed apparatus 10 or to an out-of-the-way position while roller screed apparatus 10 is in use.

In the illustrative embodiment, speed control 54 comprises a squeeze handle 86 pivotably coupled to a mount bracket 88. Mount bracket 88 is coupled to shaft 66 of roller mover 52 and is positioned such that squeeze handle 86 is accessible by operator 18 when operator 18 is using grip 64. Squeeze handle 86 is pivotable about an axis 90 relative to mount bracket 88. A throttle cable 62 is coupled to squeeze handle 86 such that pivoting about axis 90 actuates throttle cable 62. Throttle cable 62 provides a signal 56 to motor 48 to vary the speed of motor 48, which thereby varies the speed of rotation of roller assembly 12 about axis 22.

Mount end 68 of shaft 66 of roller mover 52 is received in a support bracket 92 coupled to a housing 94 of rotary transmitter 58. Support bracket 92 comprises a base 96 which couples to housing 94 and a clamp 98 coupled to base 96. Clamp 98 comprises a first portion 104 and a second portion 106 coupled to first portion 104 by two fasteners 100, 100. First portion 104 and second portion 106 are configured to form an aperture 102 sized to receive shaft 66. When shaft 66 is received in aperture 102, fasteners 100 are tightened to clamp shaft 66 between first portion 104 and second portion 106. Aperture 102 has a cylindrical shape which defines an axis of rotation 108. Shaft 66 is pivotable to any of a number of positions about axis 108 to adjust the position of roller mover 52 relative to rotary driver 26. When shaft 66 is positioned, clamp 98 is tightened to maintain the position of roller mover 52 relative to rotary driver 26. In some embodiments, one or both of the fasteners 100, 100 may be replaced by a lock similar to lock 78 to permit the position of roller mover 52 to be adjusted without the aid of tools. In other embodiments, first portion 104 may be pivotably mounted to base 96 to permit clamp 98 to pivot about a vertical axis relative to rotary transmitter 58.

Figure 5:
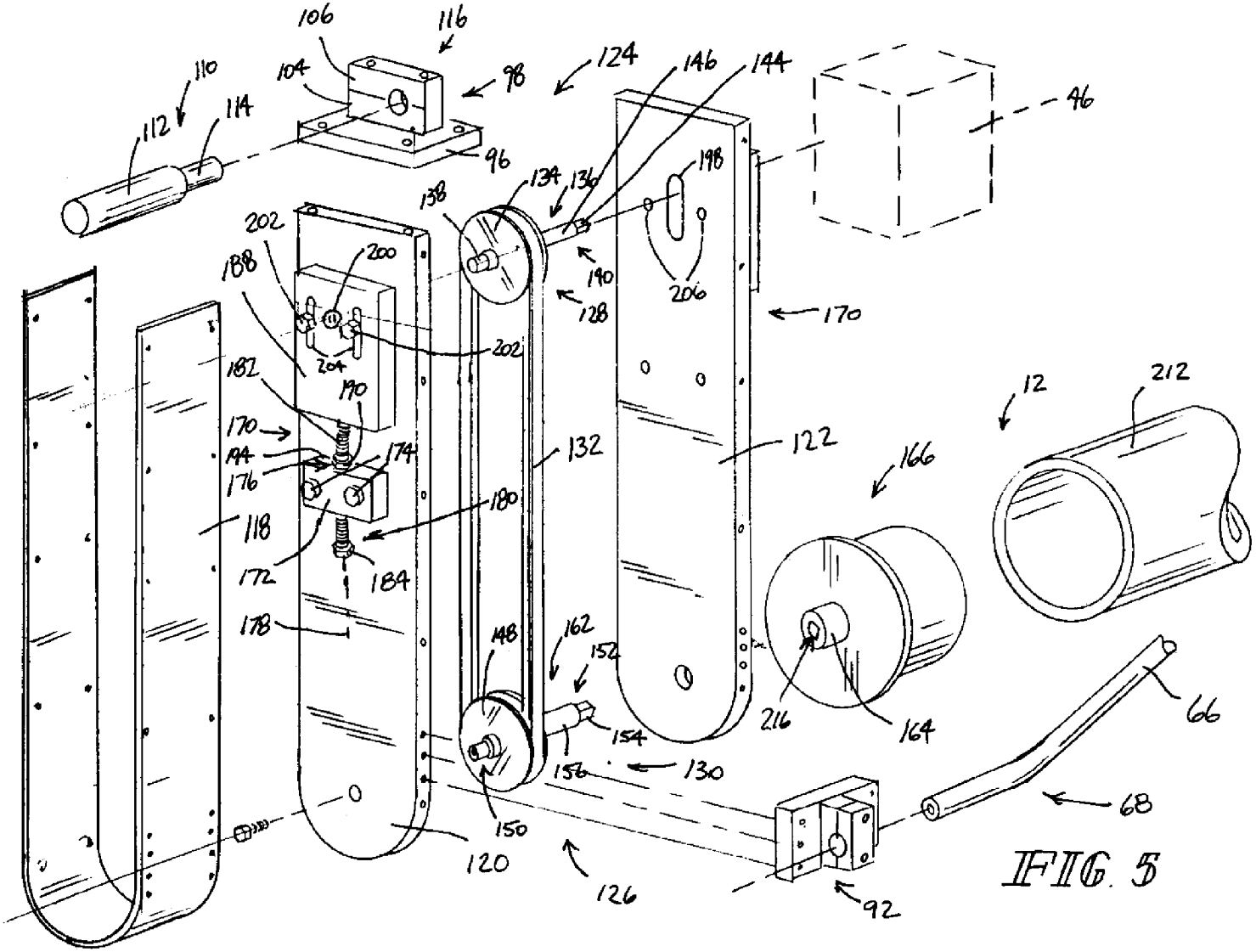
FIG. 5 is a exploded perspective assembly view of the rotary transmitter and roller of the roller screed apparatus of FIG. 1 showing from left to right a transmitter housing, a first side plate, a transmission assembly supported on by the first side plate and a second side plate, and a roller receiving rotary motion transmitted by the rotary transmitter from a power source shown in phantom.

Rotary driver 26 further comprises a lift handle 110 coupled to housing 94 by another support bracket 116 positioned at a top of rotary transmitter 58. Lift handle 110 provides a grip point for an operator 18, 20, 46 to grip and thereby move roller screed apparatus 10. Referring now to FIG. 5, lift handle 110 comprises a grip 112 and a shaft 114. Shaft 114 is received in support bracket 116. Support bracket 116 has the same structure as support bracket 92. It should be understood that while lift handle 110 is positioned such that grip 112 is directed away from power source 46, lift handle 110 may be reversed and positioned above power source 46 to provide additional clearance to the outside of rotary driver 26 such as if the roller screed apparatus 10 adjacent a wall or other structure.

Illustratively, rotary transmitter 58 has a single stage coupling power source 46 output 60 directly to roller assembly 12. As shown in FIG. 5, housing 94 of rotary transmitter 58 comprises a cover 118, and two side plates 120 and 122 coupled to cover 118. Support bracket 116 is coupled to side plates 120 and 122 at an upper end 124 of rotary transmitter 58. Side plates 120 and 122 have a semi-circular shape at a bottom end 126 rotary transmitter 58 to provide clearance relative to forms 28 and 30 and uncured concrete 44 when roller screed apparatus 10 is in use. Housing 94 captures and encloses a driver pulley 128 and a follower pulley 130 which is driven by driver pulley 128 through a connecting belt 132.

Driver pulley 128 comprises a rim 134 coupled to an axle 136. Axle 136 has a bearing end 138 and an input end 140.

Figure 6:
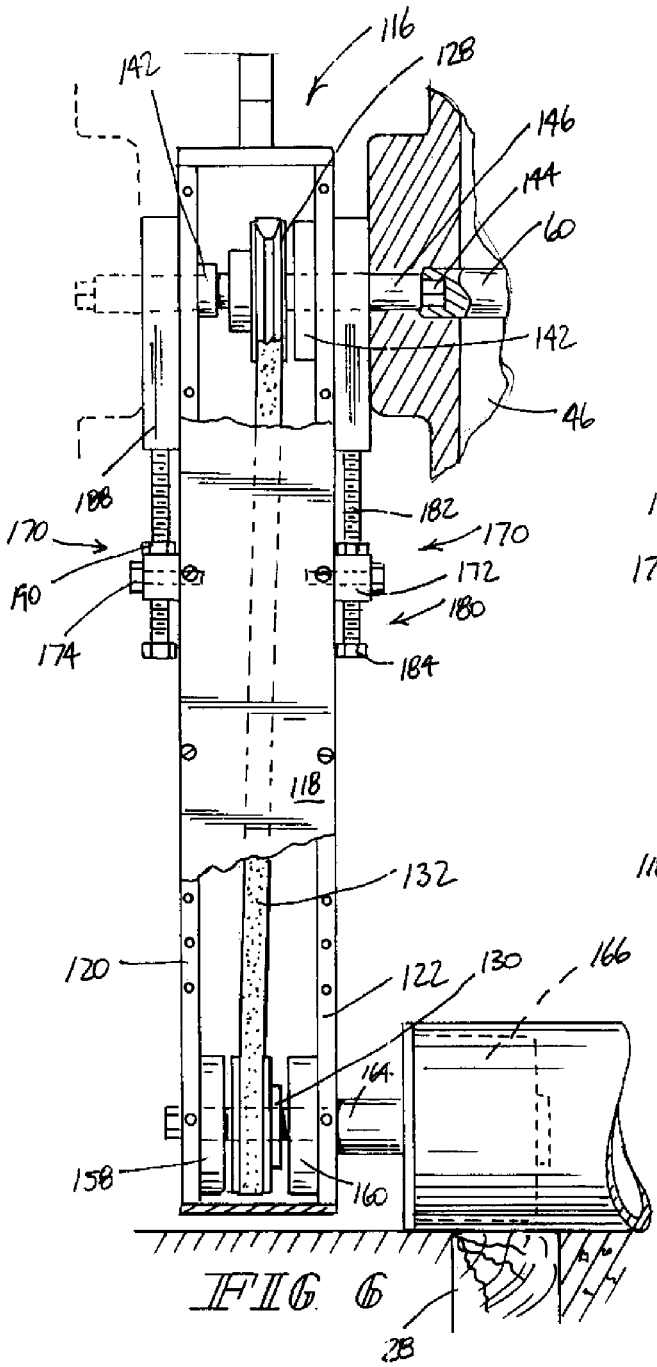
FIG. 6 is a front elevation view of a portion of the roller screed apparatus taken from the perspective of lines 6—6 of FIG. 1 with portions broken away showing components of the rotary driver and the coupling of the roller to the rotary driver.
Figure 7:
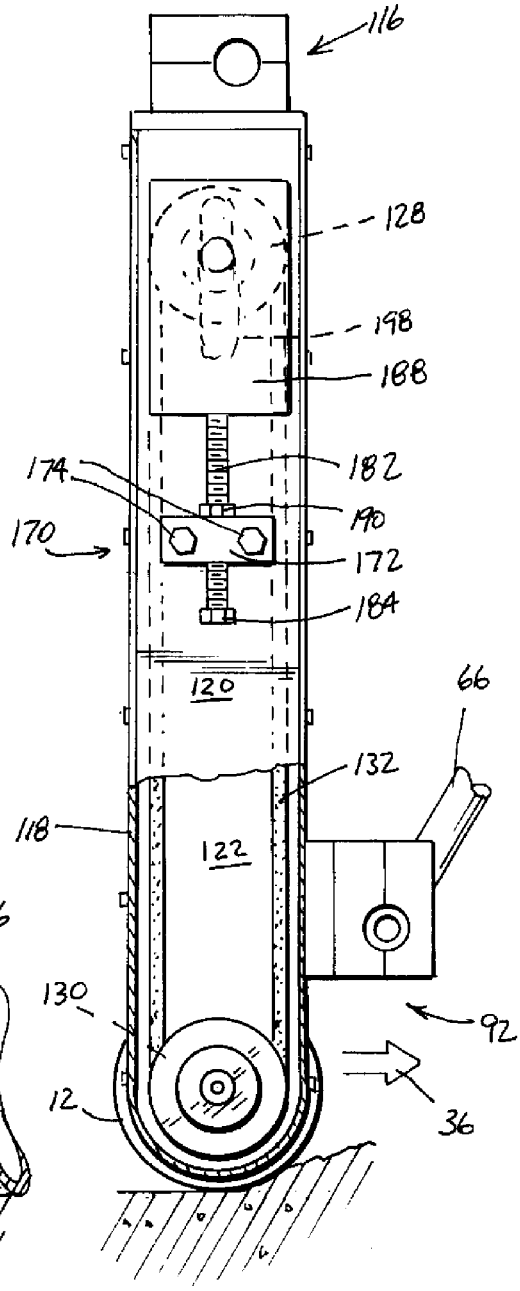
FIG. 7 is a side elevation view of a portion of the roller screed apparatus taken from the perspective of lines 7—7 of FIG. 1 with portions broken away showing components of the rotary transmitter.
Figure 8:
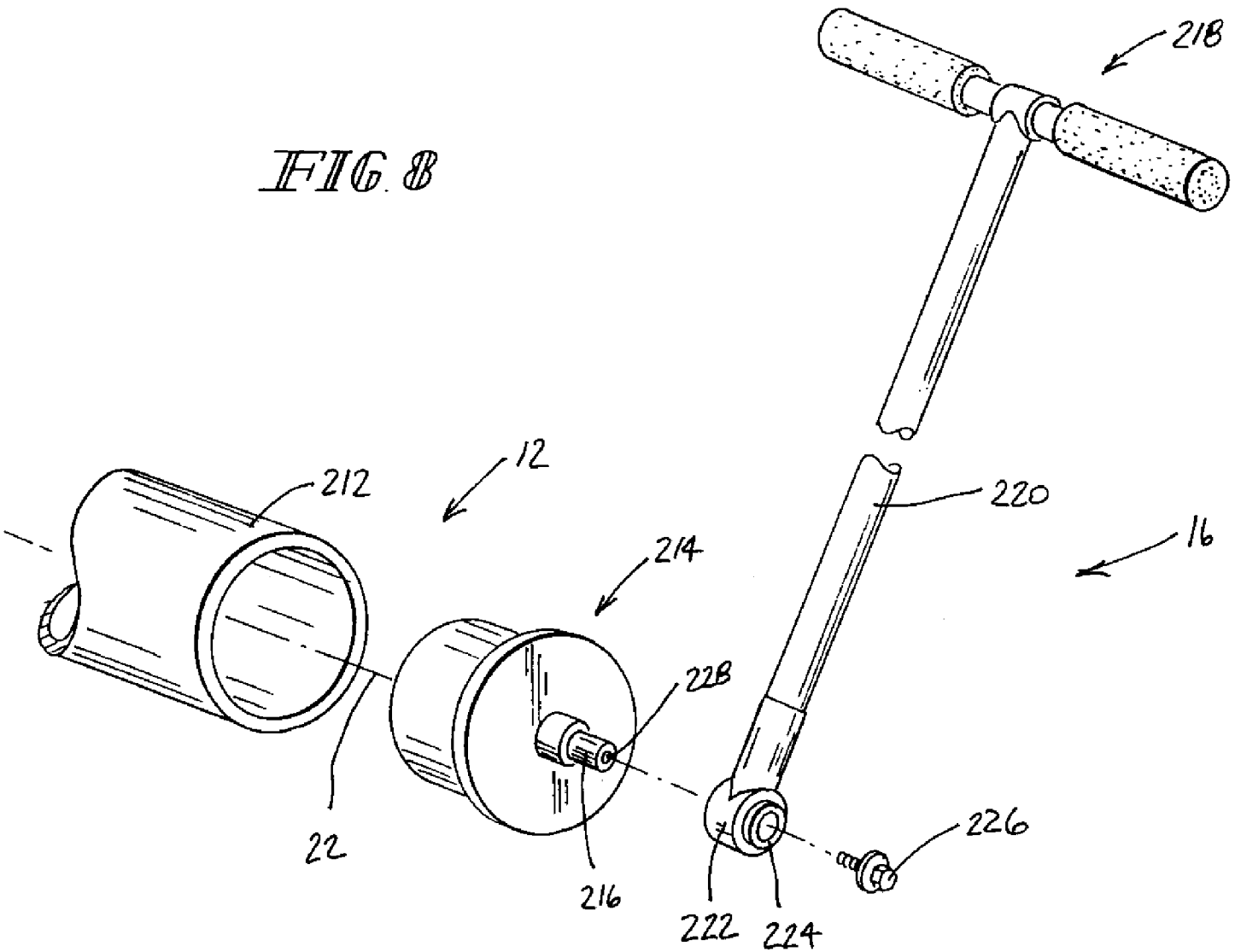
FIG. 8 is an exploded perspective assembly view of the second operator roller controller and roller of FIG. 1.

Bearing end 138 is supported in a bearing 142 (best seen in FIG. 6). Input end 140 comprises a keyed portion 144 and a shaft portion 146. Shaft portion 146 is supported in bearing 142 and keyed portion 144 is received in output 60 of power source 46. Rotational motion from power source 46 drives driver pulley 128. Connector belt 132 is a v-belt which is frictionally engaged with rim 134 as shown in FIGS. 6 and 7.

Referring to FIG. 6, power source 46 is positionable on either side of rotary transmitter 58. For example, power source 46 is shown in solid mounted in an inboard position above roller assembly 12 in FIG. 6. FIG. 6 also shows power source 46 in phantom mounted to an outboard side of rotary transmitter 58. Thus, rotary transmitter 58 is configurable to mount power source 46 in either the outboard or inboard position.

Rotation of driver pulley 128 transfers motion to connector belt 132 which is also frictionally engaged with a rim 148 of follower pulley 130. As shown in FIG. 5, rim 148 is coupled to an axle 162 which has a bearing end 150 and an output end 152. Output end 152 has a keyed portion 154 and a shaft portion 156. Referring again to FIG. 6, bearing end 150 is supported in a bearing 158 coupled to side plate 120. Shaft portion 156 of output end 152 is supported in a bearing 160. Axle 162 turns in bearings 158 and 160 as follower pulley 130 is driven by connector belt 132. Keyed portion 154 of output end 152 is received in a connector 164 of a hub 166 of roller assembly 12. Rotational motion from power source 46 is thereby by transferred to roller assembly 12 through pulley 128, connector belt 132, and follower pulley 130.

Tension is maintained in connector belt 132 by a pair of tension adjusters 170 and 172. Tension adjuster 170 comprises a fixed block 172 coupled to side plate 126 by a pair of fasteners 174. Fixed block 172 comprises a through-hole 176 has a longitudinal axis 178. Tension adjuster 170 further comprises a threaded shaft 180 which comprises a threaded body 182 and a head 184. Threaded body 182 passes through through-hole 176 and has an end 186 which is coupled to a sliding block 188. Tension adjuster 170 further comprises a threaded nut 190 received on threaded body 182 of shaft 180. Nut 190 is positioned such that a lower surface 192 of nut 190 engages an upper surface 194 of fixed block 172. Engagement of nut 190 on shaft 180 maintains the position of sliding block 188 relative to fixed block 172. Further, rotation of nut 190 changes the spacing between sliding block 188 and fixed block 172.

Sliding block 188 comprises a through-hole 200 which also acts as a journal bearing as to axle 136 of driver pulley 128. Through-hole 200 supports axle 136. Sliding block 188 further comprises a pair of slots 204, 204 which each have a longitudinal axis parallel to the longitudinal axis 178. Tension adjuster 170 further comprises two fasteners 202, 202. Each fastener 202 passes through a slot 204 and a through-hole 206 formed in each side plate 120, 122. Fasteners 202, 202 act as clamps when tightened to clamp sliding block 188 in position.

Axle 136 of driver pulley 128 is supported by sliding block 188 and passes through a slot 198 formed in each side plate 126 and 122. Slots 198 each have a longitudinal axis parallel to the longitudinal axis 178. As the distance between fixed block 172 and sliding block 188 is changed, axle 136 is positioned within the slots 198 to vary the distance between axle 136 of driver pulley 128 and axle 162 of follower pulley 130. Varying the distance between axles 136 and 162 varies the tension in connector belt 132. In the illustrative embodiment, driver pulley 128 and follower pulley 130 are the same size. Since pulleys 128 and 130 are connected through a v-belt connector belt 132 the rotational motion is transferred therebetween at a ratio of approximately 1:1. In other embodiments, the sizes of pulleys 128 and 130 may be varied to change the ratio to some other ratio such as 1:2 or 2:1. It should be understood that any of a number of ratios may be chosen.

Also, in some embodiments, pulleys 128 and 130 may be replaced with sprockets and connector belt 132 may be replaced with a drive chain. When sprockets and a chain are used, it should be understood that the ratios between the sprockets may be varied similarly to the pulleys 128 and 130.

Roller assembly 12 comprises driver hub 166, roller tube 212 coupled to driver hub 166, and a follower hub 214 coupled to roller tube 212. Connector 164 of driver hub 166 comprises a keyed receptacle 216 which is configured to receive keyed portion 154 of axle 162 to transfer rotation from axle 162 to roller assembly 12. Follower hub 214 comprises a cylindrical shaft 216 having a longitudinal axis that is generally coincident with axis of rotation 22 of roller assembly 12.

Second operator roller controller 16 comprises a grip 218 coupled to a shaft 220 and a bearing housing 222 coupled to shaft 220. Bearing housing 222 has a bearing 224 which is sized to receive shaft 216 of follower hub 214 such that hub 214 rotates within bearing 224. Second operator roller controller 16 is retained on follower hub 214 by a fastener 226 received in a threaded hole 228 formed in shaft 216 of follower hub 214. Second operator roller controller 16 is used by second operator 20 to position roller screed apparatus 10 and to pull roller screed apparatus 10 in working direction 36 to level uncured concrete 44. Bearing housing 222 comprises a ball joint which permits second operator roller controller 16 to be positioned in a number of orientations relative to roller assembly 12. This reduces the chance for side-loading bearing 224 when second operator roller controller 16 is pushed or twisted during use.

The invention claimed is:

1. A roller screed apparatus comprising a roller, and operator controller means for smoothing uncured concrete by rotating the roller to move uncured concrete and while simultaneously pulling the roller screed apparatus such that the roller levels and smoothes the uncured concrete to a predefined level wherein the means for rotating the roller comprises power source means for providing rotational output and rotational transmitter means for transmitting the rotational output from the power source to the roller to roll the roller about a longitudinal axis of the roller, wherein the rotational output from the power source means has an axis of rotation that is generally parallel to and above the longitudinal axis of the roller, and wherein the rotational transmitter means transmits rotational output from the power source to the roller through a single stage at a ratio of about 1:1.

2. The roller screed apparatus of claim 1, wherein the power source means comprises a motor and a speed reduction gearbox coupled to the motor and configured to provide rotational output.

3. The roller screed apparatus of claim 1, wherein the rotational transmitter means comprises a first input pulley coupled in-line with the power source, a second pulley coupled in-line with the roller, and a connector belt transmitting motion from the first pulley to the second pulley.

4. The roller screed apparatus of claim 1, wherein the rotational transmitter means transfers rotational output from the power source to the roller at a ratio of about 1:1.

5. The roller screed apparatus of claim 1, wherein the power source is adapted to be positioned in an in-board position or an out-board position.

6. The roller screed apparatus of claim 1, wherein the operator controller means comprises a grip and the speed control comprises squeeze handle supported on the roller mover and a throttle cable coupled to the squeeze handle at a first end and to the rotary driver at a second end, the squeeze handle configured to be used by an operator to control the speed of rotation of the roller.

7. The roller screed apparatus of claim 6, wherein the power source means is configured to provide rotational output and a rotary transmitter coupled to the power source and the roller, the rotary transmitter transferring the rotational output from the power source directly to the roller.

8. The roller screed apparatus of claim 7, wherein the power source means comprises a motor and a speed reduction gearbox coupled to the motor and configured to provide rotational output.

9. The roller screed apparatus of claim 8, wherein the motor comprises an internal combustion engine.

10. The roller screed apparatus of claim 8, wherein the motor comprises a direct current electric motor.

11. The roller screed apparatus of claim 10, wherein the roller comprises a roller tube having a longitudinal axis and an annular cross-section about the longitudinal axis, a driver hub coupled to the roller tube at a first end, the driver hub including a keyed connector configured to receive an output from the power source means, and a follower hub coupled to the roller tube at a second end, the follower hub including a bearing shaft configured to be received in a bearing housing of the second operator roller controller.

12. The roller screed apparatus of claim 1, wherein the roller comprises a roller tube having a longitudinal axis and an annular cross-section about the longitudinal axis, a driver hub coupled to the roller tube at a first end, the driver hub including a keyed connector configured to receive an output from the power source means, and a follower hub coupled to the roller tube at a second end, the follower hub including a bearing shaft configured to be received in a bearing housing of the second operator roller controller.

13. The roller screed apparatus of claim 1, comprising a handle grip configured to be used by an operator to lift and reposition the roller screed.

14. A roller screed apparatus comprising, a roller having a longitudinal axis and a cylindrical outer surface about the longitudinal axis, and operator controller means for rotating the roller about the longitudinal axis to smooth uncured concrete contacting the roller surface, moving the roller along a top surface of a concrete form to level the uncured concrete to be generally coplanar to the top surface of the form while smoothing the uncured concrete, and controlling the rotational speed of the roller about the longitudinal axis to match the speed at which the roller is moved along the top surface of the concrete form to provide an acceptable smoothness wherein the means for driving the roller about the longitudinal axis includes power source means including a drive shaft having an axis if rotation that is generally parallel to and above the axis of rotation of the roller, and rotary transmitter means for transmitting the output from the drive shaft to the roller.

15. The roller screed apparatus of claim 14, wherein the means for transmitting the output to the roller transmits the output through a single stage at a ratio of about 1:1.

* * * * *